United States Patent [19]

Grabhorn

[11] Patent Number: 4,837,955

[45] Date of Patent: Jun. 13, 1989

[54] BALLOON STRUCTURE

[75] Inventor: Robert H. Grabhorn, Indianapolis, Ind.

[73] Assignee: Biodot International, Incorporated, Indianapolis, Ind.

[21] Appl. No.: 165,022

[22] Filed: Mar. 7, 1988

[51] Int. Cl.[4] ..... G09F 21/06

[52] U.S. Cl. ..... 40/214; 446/220; 40/661; 40/124.2

[58] Field of Search ..... 40/212, 214, 215; 446/220, 221, 222, 223; 116/210, 661, 124.2

[56] References Cited

U.S. PATENT DOCUMENTS

| | | | |
|---|---|---|---|
| 2,383,390 | 8/1945 | Jacobs | 40/214 |
| 2,463,517 | 3/1949 | Chromak | 446/220 |
| 2,871,343 | 1/1959 | Whitney | 446/220 |
| 3,771,247 | 11/1973 | DeHarak | 40/212 |
| 4,292,999 | 10/1981 | Szollmann | 40/214 |
| 4,704,934 | 11/1987 | Nosrati | 446/220 |

FOREIGN PATENT DOCUMENTS

| | | | |
|---|---|---|---|
| 893680 | 4/1962 | United Kingdom | 446/221 |

*Primary Examiner*—Robert Peshock
*Assistant Examiner*—Michael Lynch
*Attorney, Agent, or Firm*—Barnes & Thornburg

[57] ABSTRACT

An apparatus is provided for displaying a visual exhibit. The apparatus includes a display unit for housing an exhibit and a chamber unit for housing the display unit. The display unit includes a transparent envelope having a proximal portion configured to form an opening for receiving the exhibit and a distal portion to cover and protect the exhibit. The chamber unit includes a transparent, expandable compartment defined by an outer wall. The wall is formed to include an aperture for permitting the exhibit to be inserted into the display unit from outside the chamber unit. The aperture is coupled to the proximal portion of the display unit to suspend the display unit inside the chamber unit. An inflator extends through the wall of the compartment for filling the compartment with a gas. The inflator is coupled to the display unit to orient the display unit in a predetermined relation inside the chamber unit.

11 Claims, 1 Drawing Sheet

BALLOON STRUCTURE

BACKGROUND AND SUMMARY OF THE INVENTION

This invention relates to an inflatable display device, and particularly to a balloon structure having a transparent, inflatable outer compartment and a transparent display compartment situated in the interior space provided by the outer compartment so that a visual exhibit in a display compartment can be seen from outside the inflated outer compartment.

Balloons are often used for advertising products and services, as well as events and activities. Conventionally, the advertising is printed on the exterior surface of the balloon so that, upon inflation of the balloon, viewers can read the advertisement. These balloons provide no flexibility to change the message displayed, and therefore balloons with new advertising must be ordered for each event or activity.

One object of the present invention is to provide a balloon structure in which an exhibit can be easily changed, thereby providing flexibility in advertising.

Another object of the present invention is to provide a display device for displaying a visual exhibit that is free from distortion and easy for the viewer to read.

In accordance with the present invention, a balloon structure includes an inflatable body made of a transparent material and having a side wall configured to provide an interior volume defined within the inflatable body. The side wall is also configured to provide a slit opening that is in communication with the interior volume. The ballon structure also includes receptacle means extending into the interior volume of the inflatable body for receiving an article or exhibit, and fill means extending through the side wall for introducing a gas into the interior volume to inflate the inflatable body. The receptacle means is coupled to the side wall in communication with the slit opening in the side wall to permit the introduction of articles or exhibits into the receptacle means via the slit opening independent of the degree of inflation of the inflatable body. The receptacle means is also formed from a transparent material to permit visual inspection of the article or exhibit received in the receptacle means through the inflatable body.

In preferred embodiments of the present invention, the balloon structure includes an expandable, transparent outer compartment and a generally planer, transparent display compartment for housing a visual display or exhibit. The display compartment is situated in the interior space provided by the outer compartment. A side wall of the outer compartment is formed to provide an access opening into the interior of the outer compartment. The display compartment includes an open proximal end coupled to the access opening so that access to the inner display compartment is available without deflating the outer compartment.

The display compartment also includes a distal end suspended in the interior space of the outer compartment to support and protect the exhibit. A filler sleeve extends through another side wall of the outer compartment and is coupled to the distal end of the display compartment to orient the display compartment in a predetermined relation inside the outer compartment upon inflation of the outer compartment.

The filler sleeve includes a first valve located near the point of intersection of the filler sleeve and the side wall of the outer compartment, and a second valve located near the coupling point of the filler sleeve and the inner display compartment. A gas-insertion tube can be inserted through the valves to introduce a gas into the interior space of the outer compartment. The valves automatically close to prevent gas from escaping the outer compartment upon removal of the gas-insertion tube after the interior space has been inflated to the desired level.

The filler sleeve also includes outlet means for dispensing the gas introduced into the interior volume of the inflatable body in a direction away from the display compartment. This orientation acts to enhance the stability of the display compartment in its predetermined orientation during inflation of the outer compartment.

One feature of the present invention is that the balloon structure is configured to permit the user to change the visual exhibit or article displayed within the balloon structure easily by providing an inflatable, transparent outer compartment and receptacle means for displaying the visual exhibit situated in the interior space provided by the outer compartment. The outer compartment is formed to include an access opening, thereby allowing an exhibit to be inserted directly into the receptacle means through a side wall of the outer compartment. One advantage of the foregoing structure is that the present invention permits substantial flexibility in advertising and allows the balloon structure to be reused for different events instead of being limited to a single event like conventional balloons.

Another feature of the present invention is that the fill means extends through another side wall of the outer compartment and is coupled to the receptacle means to orient the receptacle means in a predetermined relation to the outer compartment upon inflation of the outer compartment. One advantage of the foregoing structure is that easy viewing of the visual exhibit from outside the transparent outer compartment is permitted by preventing movement or distortion of the exhibit.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying FIGS. in which.

DETAILED DESCRIPTION OF THE DRAWINGS

Figure 1:
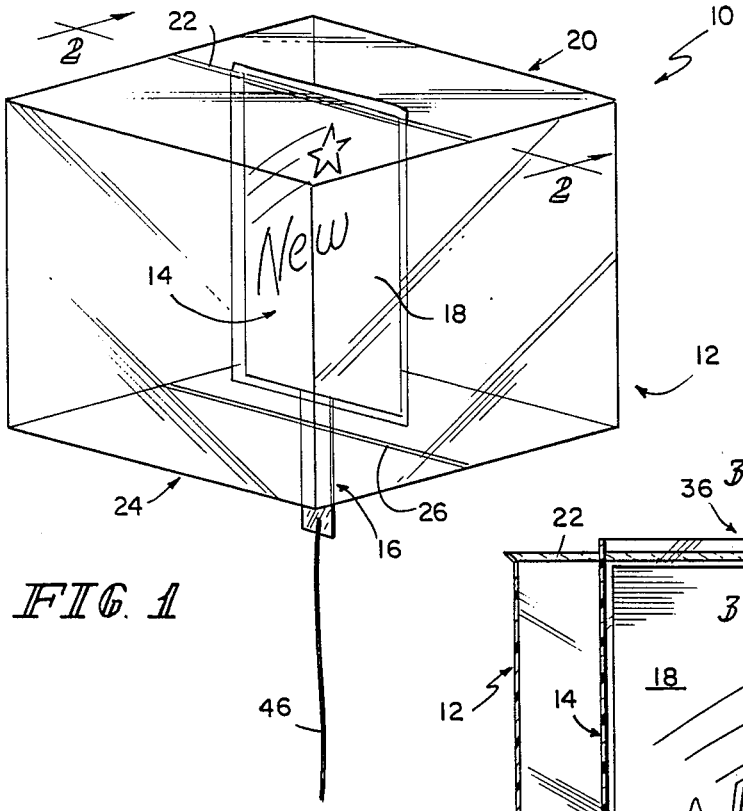
FIG. 1 is a perspective view of a preferred embodiment of a balloon structure in accordance with the present invention.

The balloon structure 10 shown in FIG. 1 includes a transparent, inflatable outer compartment 12, a transparent display compartment 14 situated in the interior space provided by outer compartment 12, and a filler sleeve 16. The outer compartment 12 includes a top side wall 20 having a top seam 22 and a bottom side wall 24 having a bottom seam 26.

Figure 3:
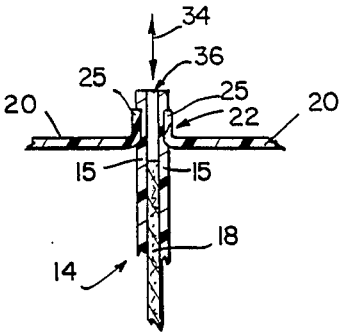
FIG. 3 is a sectional view taken along lines 3—3 of FIG. 2 showing an access opening formed in a side wall of the outer compartment.
Figure 2:
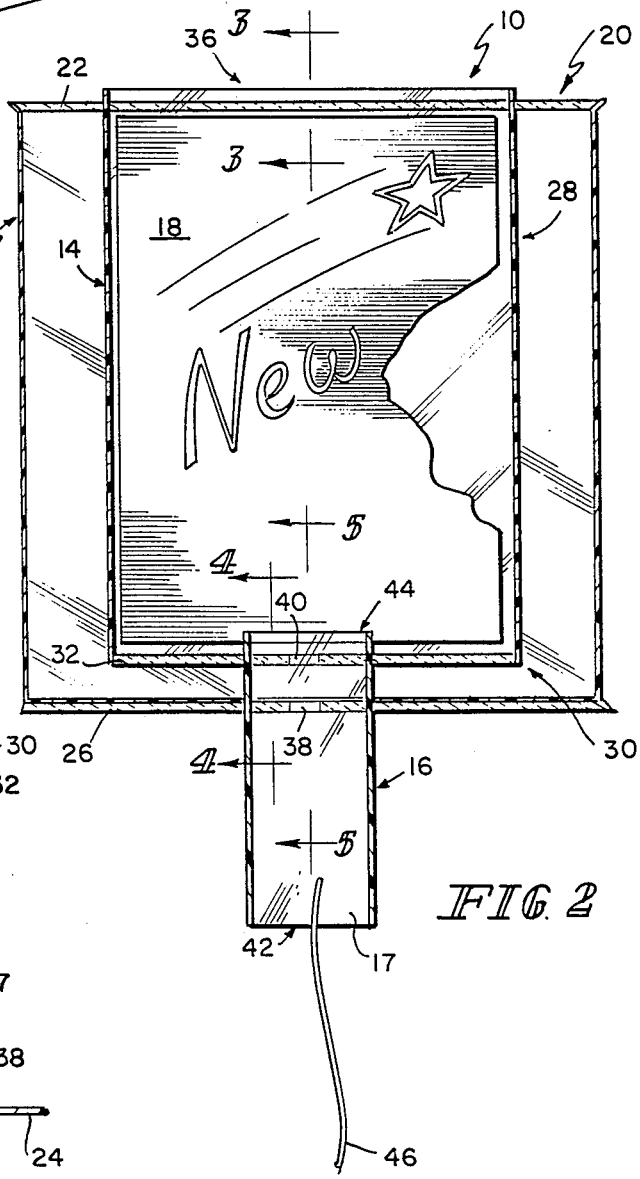
FIG. 2 is a sectional view taken along lines 2—2 of FIG. 1 showing the relation of an expandable outer compartment with an interior display compartment and a filler sleeve.

The display compartment 14 includes a transparent envelope having an open proximal portion 28 and a distal portion 30 as shown in FIG. 2. The proximal portion 28 is coupled to top seam 22 of outer compartment 12. The top seam 22 is separated in the area abutting display compartment 14 to form opposite upturned edges 25. The upturned edges 25 of the separated top seam 22 are sealed on opposite side walls 15 of display compartment 14 as illustrated in FIG. 3. An exhibit 18 can therefore be inserted into display compartment 14 through an access opening 36 without deflating outer compartment 12. Arrows 34 show the direction of insertion and extraction of an exhibit 18 from the display compartment 14. A seam 23 seals the distal portion 30 of the display compartment 14 to maintain exhibit 18 in the proper position as shown in FIG. 2.

Because the balloon structure 10 provides access to display compartment 14 independent of the degree of inflation of outer compartment 12, the user can readily exchange exhibits 18 in a matter of seconds. The balloon structure therefore provides flexibility in advertising and can be used indefinitely.

Figure 4:
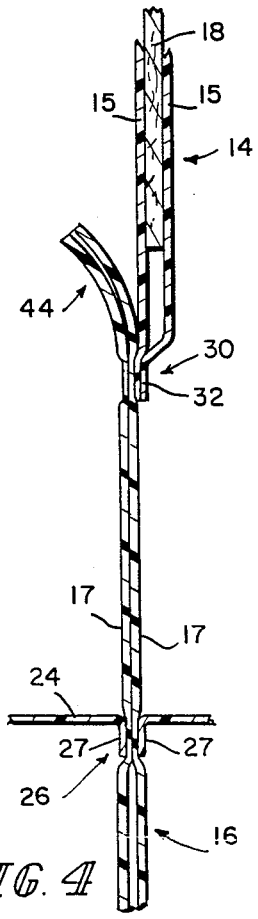
FIG. 4 is a sectional view taken along lines 4—4 of FIG. 2 showing a sealed portion of the filler sleeve which acts to prevent gas from escaping from the outer compartment.

A filler sleeve 16 extends through bottom seam 26 of outer compartment 12 and is coupled to seam 23 of display compartment 14 as illustrated in FIG. 4. Bottom seam 26 is separated in the area abutting filler sleeve 16 to form downturned edges 27. The downward edges 27 are coupled on opposite side walls 17 of filler sleeve 16, thereby preventing gas from escaping outer compartment 12. Seam 32 of display compartment 14 is coupled to one side of filler sleeve 16 so that when outer compartment 12 is fully inflated the display compartment 14 is prevented from substantial rotation or movement inside outer compartment 12.

The tethering function of filler sleeve 16 secures display compartment 14 in a predetermined orientation inside outer compartment 12. A visual exhibit 18 can therefore by read easily through outer compartment 12 without distortion of the visual image or distraction of the reader.

Filler sleeve 16 includes a first valve 38 and a second valve 40 as shown in FIG. 2. First valve 38 and second valve 40 are located substantially near the center of filler sleeve 16. To inflate the outer compartment 12 with a gas, a gas insertion tube (not shown) can be inserted into the filler sleeve 16 and desirably through first valve 38 and second valve 40.

Figure 5:
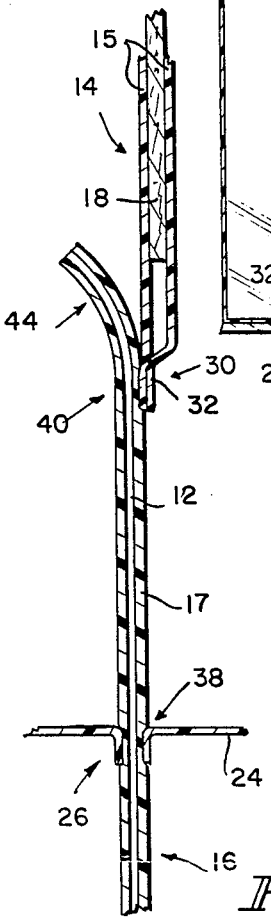
FIG. 5 is a sectional view taken along lines 5—5 of FIG. 2 showing an open position of the filler sleeve for introducing a gas into the outer compartment.

The filler sleeve 16 with first valve 38 and second valve 40 in their open positions form an air intake passage 42 in filler sleeve 16 as shown in FIG. 5. After inflation to a sufficient level, the side walls 17 of filler sleeve 16 will seal together in areas surrounding the first valve 38 and second valve 40 along the bottom seam 26 and seam 32 of the display compartment respectively, thereby preventing gas from escaping outer compartment 12.

Filler sleeve 16 includes outlet means 44 (FIGS. 4 and 5) to dispense the gas introduced into the interior volume of outer compartment 12 in a direction away from display compartment 14. This directing of the inflowing air or gas enhances the stability of display compartment 14 in its predetermined orientation during inflation of outer compartment 12.

In operation, a gas insertion tube (not shown) may be inserted into filler sleeve 16 so that the tube extends through first valve 38 and second valve 40. A gas is then introduced into outer compartment 12 through the filler sleeve 16, thereby causing the outer compartment 12 to expand. The proximal portion 28 of display compartment 14 is open and coupled to the upturned edges 25 in top seam 22 of top side wall 20 to provide receptacle means for an exhibit so that display compartment 14 is suspended in the interior space provided by outer compartment 12. The filler sleeve 16 is coupled to the distal portion 30 of display compartment 14 to orient the display compartment in a predetermined relation inside the outer compartment 12. Outlet means 44 of filler sleeve 16 directs the incoming gas away from display compartment 14 to enhance the stability of the display compartment 14 inside outer compartment 12 during filling.

The visual exhibit 18 can be inserted through access opening 36 into display compartment 14 independent of the degree of inflation of outer compartment 12. When outer compartment 12 is fully inflated, the exhibit 18 is visible through the side walls of outer compartment 12. If the gas introduced into outer compartment 12 is lighter than air, a tether string 46 can be attached to secure the balloon structure 10 in a predetermined position. The balloon structure 10 provides flexibility in advertising because the structure can be reused for each event by simply changing the exhibit 18 inside the structure.

Although the invention has been described in detail with reference to a certain preferred embodiment, variations and modifications exist within the scope and spirit of the invention as described and defined in the following claims.

What is claimed is:

1. An apparatus for displaying a visual exhibit, the apparatus comprising display means for housing an exhibit, the display means including a transparent envelope having a proximal portion configured to form an opening for receiving the exhibit and a distal portion to cover and protect the exhibit, chamber means for housing the display means, the chamber means including a transparent, expandable compartment defined by an outer wall, the wall being formed to include aperture means for permitting the exhibit to be inserted into the display means from outside the chamber means, the aperture means being coupled to the proximal portion of the display means to suspend the display means inside the chamber means, and inflation means extending through the wall of the compartment for filling the compartment with a gas, the inflation means being coupled to the display means to orient the display means in a predetermined relation inside the chamber means.

2. The apparatus of claim 1, wherein the inflation means includes a filler sleeve extending through the wall of the compartment and coupled to the distal portion of the display means, the filler sleeve having first closure means and second closure means, the first closure means being located in close proximity to the point of intersection of the filler sleeve and the wall of the compartment, and the second closure means being located in close proximity to the coupling point of the filler sleeve and the display means.

3. The apparatus of claim 2, wherein the display means is generally planer in shape having a predetermined length and width, and wherein the filler sleeve has a width that is at least one-third the display means width, thereby preventing substantial movement of the display means inside the chamber means.

4. The apparatus of claim 3, wherein the first closure means and second closure means include a normally closed first position to prevent the gas from escaping the compartment and an open second position to permit a gas-insertion tube to extend through the filler sleeve to fill the compartment with a gas, and wherein upon removal of the gas-insertion tube, the first and second closure means automatically return to their normally closed first position, thereby preventing the gas from escaping the chamber means.

5. A transparent apparatus for visually displaying an article contained therein, the transparent apparatus comprising an inflatable body made of a transparent material and having a side wall configured to provide an interior volume defined within the inflatable body and a slit opening communicating with the interior volume, fill means extending through the side wall for introducing a gas into the interior volume to inflate the inflatable body, receptacle means extending into the interior volume of the inflatable body for receiving the article, the receptacle means being coupled to the side wall in communication with the slit opening in the side wall to permit introduction of articles into the receptacle means via the slit opening independent of the degree of inflation of the inflatable body, the receptacle means being made of a transparent material to permit visual inspection of an article received in the receptacle means, whereby the article so received is observable through the inflatable body.

6. The transparent apparatus of claim 5, wherein the receptacle means includes a transparent pouch having an open-ended proximal portion coupled to the side wall in communication with the slit opening and a depending distal portion and the fill means interconnects the side wall and the depending distal portion to tether the transparent pouch in about a predetermined orientation within the inflatable body upon inflation thereof.

7. The transparent apparatus of claim 6, wherein the transparent pouch includes a side wall extending between the proximal and distal portions and the fill means includes a fill tube having an inlet end positioned outside of the interior volume, an outlet end positioned in close proximity to the side wall of the transparent pouch, and a middle portion extending between the inlet and outlet ends, the middle portion being coupled to both the side wall of the inflatable body and the distal portion of the transparent pouch.

8. The transparent apparatus of claim 6, wherein the fill means includes outlet means for dispensing gas introduced into the interior volume of the inflatable body in a direction away from the transparent pouch to enhance the stability of the tethered pouch in its predetermined orientation during inflation of the inflatable body.

9. The transparent apparatus of claim 8, wherein the fill means includes inlet means for communicating with a source of inflation gas and conduit means for interconnecting the inlet means and the outlet means and the conduit means is rigidly coupled to both of the inflatable body and the distal portion of the transparent pouch.

10. The transparent display apparatus comprising a transparent balloon having a plurality of exterior surfaces, one of the exterior surfaces having a slit defining an opening therein, and a transparent receptacle having an exterior surface and an interior opening for receiving an article to be displayed, said receptacle exterior surface sealably coupled to said balloon opening suspending the transparent receptacle inside the transparent balloon, whereby said article can be removably disposed in the transparent receptacle and is observable through the transparent balloon.

11. The transparent display apparatus of claim 10, wherein the transparent balloon further includes fill means for introducing a gas into an interior volume defined within the transparent balloon and the fill means is coupled to the transparent balloon and to the receptacle to tether the transparent receptacle in a predetermined position within the transparent balloon upon inflation of the transparent balloon.

* * * * *